United States Patent [19]

Duchemin

[11] Patent Number: 4,484,706

[45] Date of Patent: Nov. 27, 1984

[54] RESILIENT RAIL FASTENER

[75] Inventor: Michel Duchemin, Douai, France

[73] Assignee: Ressorts Industrie, Paris, France

[21] Appl. No.: 502,620

[22] Filed: Jun. 6, 1983

[51] Int. Cl.[3] ..... E01B 9/46

[52] U.S. Cl. ..... 238/349; 238/338

[58] Field of Search ..... 238/349, 310, 338, 343, 238/351

[56] References Cited

U.S. PATENT DOCUMENTS

| | | | |
|---|---|---|---|
| 1,798,357 | 3/1931 | Ruping | 238/349 |
| 3,004,715 | 10/1961 | Gadd | 238/349 X |
| 3,861,593 | 1/1975 | Senior et al. | 238/349 |
| 4,054,247 | 10/1977 | Duchemin | 238/349 |
| 4,266,720 | 5/1981 | Harmsen | 238/349 |

*Primary Examiner*—Randolph Reese
*Assistant Examiner*—Glenn Foster
*Attorney, Agent, or Firm*—Mason, Fenwick & Lawrence

[57] ABSTRACT

A resilient fastener for fastening a rail on its support, comprising a flexible blade of constant thickness having a longitudinal edge to be disposed parallel to the axis of the rail and applied against the rail flange. The blade has two orifices spaced from the longitudinal edge and arranged so that they are situated above the rail support and close to the edge of the rail when in fastening position. The longitudinal edge is curved to a convex shape presenting a substantially cylindrical surface of which the directrix is a curve inscribed between the warped shape assumed by the blade when loaded in its center and the arc of a circle passing through the blade center and the centers of the orifices.

4 Claims, 9 Drawing Figures

RESILIENT RAIL FASTENER

The present invention relates to the resilient fastening of rails on their support and more particularly on sleepers made of wood.

The ever-increasing travelling speed of trains and of the loads imposed on the axle, coupled with the standardization of long welded rails, makes it necessary for the rails to be very tightly fastened to each support with a strong and constant force despite the vibrations and strong stresses to which they are subjected when trains are passing.

This problem can be solved in a number of cases, and more particularly when the sleepers are made of hard wood, by using the device described in U.S. Pat. No. 4,353,503. In said device, a tie-plate being interposed between the rail and the sleeper, a sleeper-screw is screwed on each side of the rail through a flexible metal plate, initially bent in parallel to the rail and provided in its center with a hole for receiving through the sleeper-screw. When the sleeper-screw is screwed tightly into the wood, the plate is straightened on the rail flange and in contact therewith through its entire length. The initial bending of the metal plate determines the force applied on the rail. If the rail happens to loosen, the plate resiliently resumes a certain curve and thus indicates that the force fastening the rail has reduced.

In some case, regretfully, for example when the sleepers are made of a softer wood, the use of the device according to U.S. Pat. No. 4,353,503 becomes more delicate. Indeed, in those cases, the rail fastening force has to be reduced especially if the diameter of the sleeper screw is limited, for example in order to pass through the orifice provided in a metallic plate gripped between the rail and the sleeper.

It is the object of the present invention to retain the advantages of the device described in U.S. Pat. No. 4,353,503 whilst doubling the rail fastening force. The invention proposes to this effect a fastener fixed on the sleeper by means of two sleeper-screws which go right through it and which are far enough apart for each one to be able to use all the resistance of the wood. When released, said fastener is curved in parallel to the rail, but unlike what is described in U.S. Pat. No. 4,353,503, it is its convexity which, before the fastener is screwed in, is facing the rail flange on which it rests. The simultaneous tightening in of the two screw-in members straightens the fastener and applies it through its entire length against the rail flange. The rail fastener is therefore formed by a flat blade which is curved and provided, close to each one of its ends, with an orifice designed to receive the sleeper screws.

Rail fasteners have already been described in U.S. Pat. No. 4,266,720 in which a central part is constituted by an element which is curved in parallel to the rail flange. But in U.S. Pat. No. 4,266,720, the ends of the fastener rests, before any screwing-in, on the rail flange, whereas, according to the invention, the ends of the fastener can only be in contact with the rail when said fastener is screwed on said rail.

The fastener according to the present invention has the following advantages:

The great length of contact with the rail is little affected by the passage of a train on the rail. But, if for some reason, the rail should loosen up, a very visible clearance would be created between the ends of the fastener and the rail flange, and would indicate a reduction in the tightening and be measurable. Retightening then is easy.

The great length of permanent contact with the rail prevents any creeping of said rail and any reciprocal wearing.

The bending stresses on the blade are maximum in the center of said blade, but there is no discontinuity or orifices in that part.

The orifices provided to receive the sleeper-screws are situated on either side of said central part in areas where bending stresses are minimum. In fact, for an equal rail fastening force, the orifices provided in the blade are smaller than those found in fasteners working with only one tightening member.

The presence of two tightening members or screws prevents the fastener from pivoting whether during the screwing operation or during functioning.

The invention will be more readily understood on reading the following description with reference to the accompanying drawings, in which.

Figure 1:
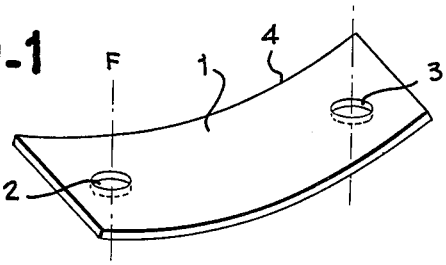
FIG. 1 is a perspective view of the fastener according to the invention.

Referring first to FIG. 1, this shows that the fastener according to the invention is a spring blade 1, which is provided close to its ends with orifices 2, 3, said orifices being at equal distance from the edge 4 of the blade 1 and at equal distance from the ends. The blade is curved between said orifices.

Figure 2:
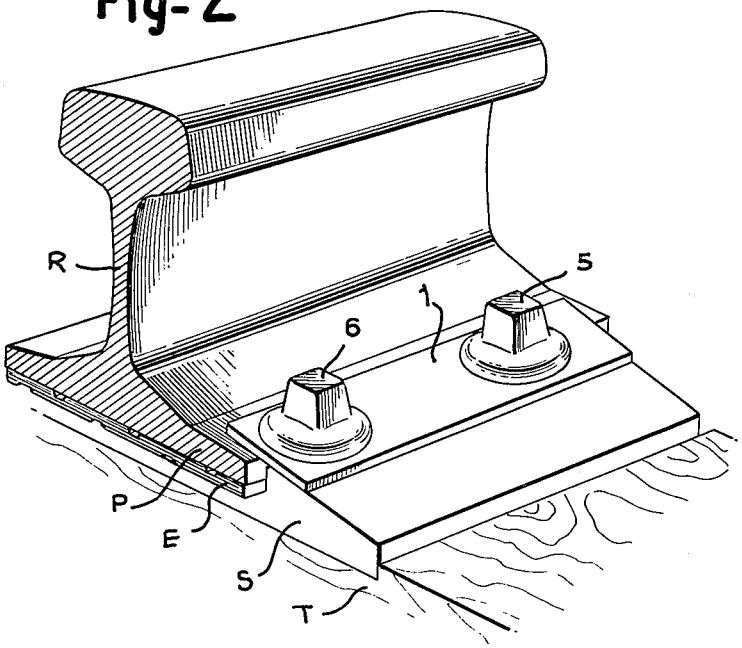
FIG. 2 is a perspective view of a fastener according to the invention, tightly screwed on the rail flange by way of two sleeper-screws which are screwed in a wooden sleeper.

FIG. 2 shows a rail R of which the flange P is fixed, with the tie-plate S, on the sleeper T, via the blade 1 screwed tightly both on the sleeper P and on the tie-plate S by means of two sleeper-screws 5 and 6 screwed into the sleeper T through orifices 2 and 3 of the blade 1 and through corresponding orifices provided in the tie-plate S.

A resilient plate E is intercalated between the rail R and the tie-plate S.

Figure 3:
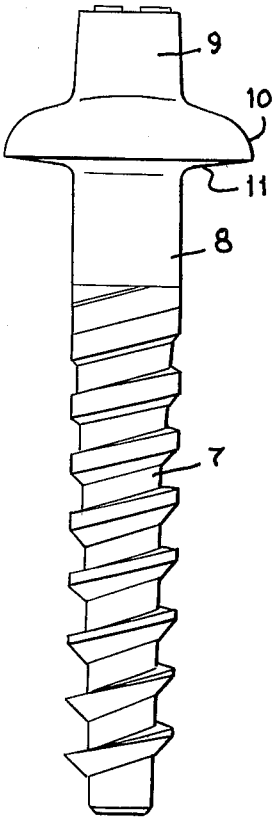
FIG. 3 is an elevational view of one of the sleeper-screws.

Every sleeper-screw 5 and 6 comprises, as shown in FIG. 3, a threaded body 7 topped by a cylindrical or slightly truncated collar 8 and by a head 9 with a base 10, the lower face 11 of which is slightly spherical or conical. The contact of this face 11 with the blade 1 is a circumference.

The blade 1, which is applied against the flange P of the rail R by the sleeper-screws 5 and 6, is straightened and becomes flat, especially between orifices 2 and 3.

When a train passes over the rail R, the plate E is compressed, the rail as a result sinks in slightly, followed by the blade 1 which curves up a little close to sleeper-screws 5 and 6 whilst remaining in contact with the rail by a large portion of its lower face which has remained flat. The ends of the blade 1, beyond orifices 2 and 3, are inclined, causing a clearance to appear which indicates that the rail has started to loosen.

This is obtained due to a special design of the center part of the blade in the released state.

Figure 4:
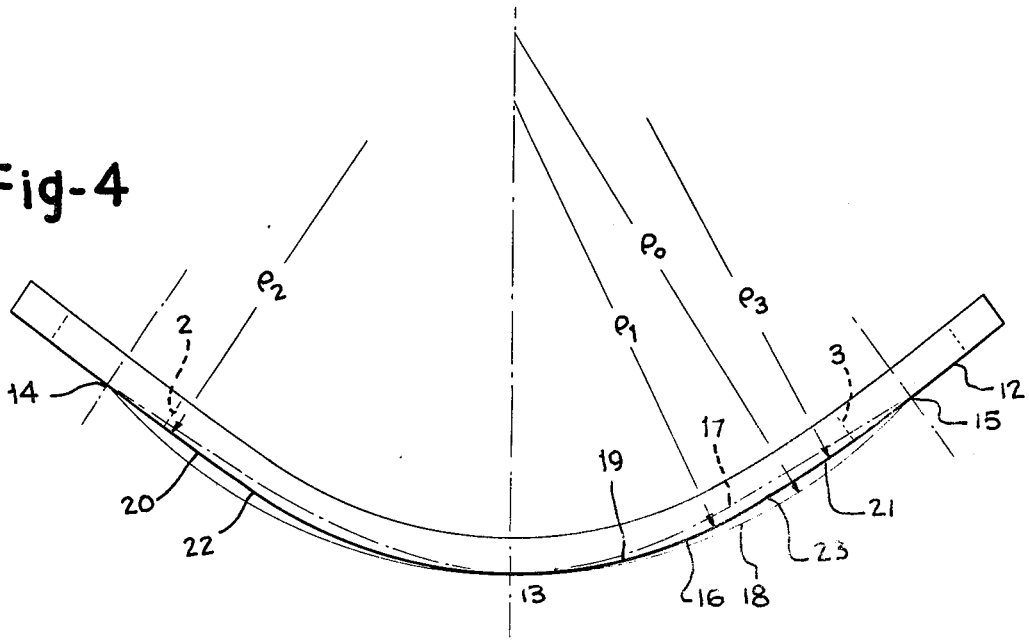
FIG. 4 is an elevational view of the blade shown in FIG. 1.

As can be seen in FIG. 4, the blade 1 and more particularly its lower face 12 is a cylinder which will be positioned on the rail, on the generatrix 13 situated at equal distance from orifices 2 and 3. Between the center 14 of orifice 2 and the center 15 of orifice 3, the directrix of said cylinder is a convex curve which is inscribed between two curves defined as follows:

(1) The warped shape 17 which the blade 1, supported in points 14 and 15, would adopt if said blade was loaded in its center 13.

(2) The arc of circle 18 of radius $\rho_0$ passing through the same points 14, 13 and 15.

If the directrix 16 were to adopt exactly the warped shape 17, a central zone would be left, when the blade is tightly screwed on the rail flange, where said blade would exert a particularly strong force on said rail flange.

If on the contrary, the directrix 16 were to adopt exactly the shape of the arc of circle 18, then it would be necessary to exert much too high a force in order to bring the entire blade in contact with the rail flange.

The choice of a convex curve between the warped shape 17 and the arc of circle 18 was therefore necessary in order to avoid these two problems.

The directrix 16 such as defined hereinabove, is advantageously constituted by an arc of circle 19 of radius $\rho_1 < \rho_0$, and by arcs 20 and 21, drawn tangentially in 22 and 23 to said arc 19, from points 14 and 15, with a radius $\rho_2 = \rho_3$ which is clearly greater than $\rho_0$. Beyond points 14 and 15, the directrix is straight and tangential to arcs 20 and 21.

Once the sleeper-screws 5 and 6 have been screwed in tightly, the blade 1 remains straight, with a constant strain from 22 to 23 over the entire surface corresponding to arc 19; the surfaces corresponding to arcs 20 and 21 are always less under strain and more or less deformed when a wheel passes on the rail. Such a design of the blade 1 gives the best results of resistance to fatigue.

Figure 5:
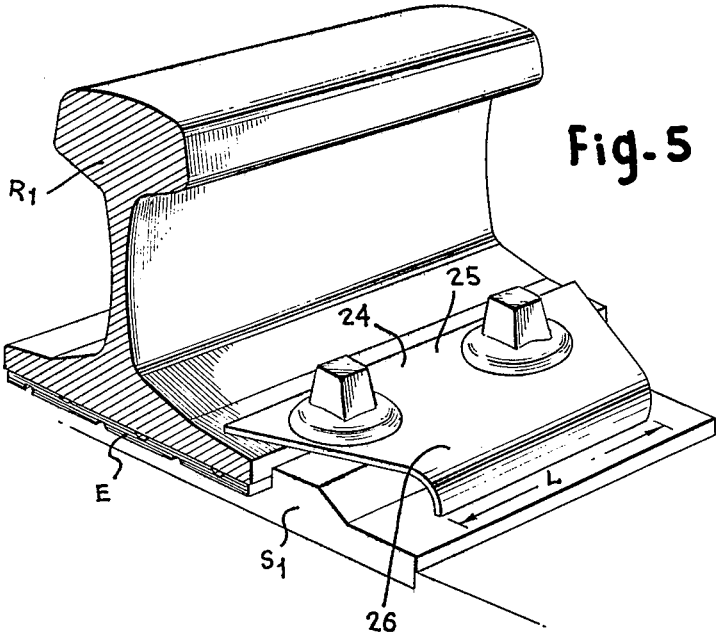
FIG. 5 is a variant of FIG. 2.

Said design of the blade 1 is also advantageous for all of the part 24 of the blade 25 which covers the rail flange R1 illustrated in FIG. 5. According to this variant, a plate S1 mounted free under the blade 25, aids the movement of the latter. And said blade 25 rests on the plate S1 by way of a tie-piece 26.

The length L of tie-piece 26 is shorter than the arc 22, 13, 23, so as not to stiffen the plate 25 in the areas close to the sleeper-screws where it is continually deformed.

Figure 6:
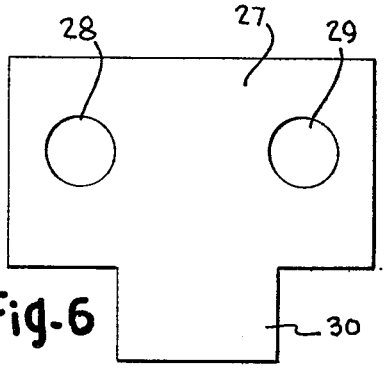
FIGS. 6, 7 and 8 are plan views of the fasteners according to a variant of FIG. 1.

According to the plan view of the blade 25 shown in FIG. 6, said blade is a rectangular shape 27, with orifices 28 and 29 and with a projecting part 30 constituting the tie-piece resting on the plate.

Figure 7:
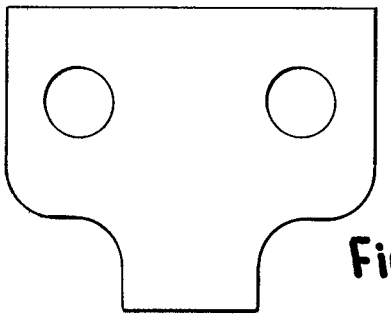
Figure 8:
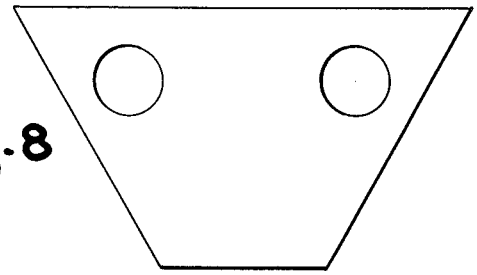

To avoid sharp angles, it is also possible for the blade to have the shape illustrated in FIG. 7 or simply the trapezoidal shape illustrated in FIG. 8.

Figure 9:
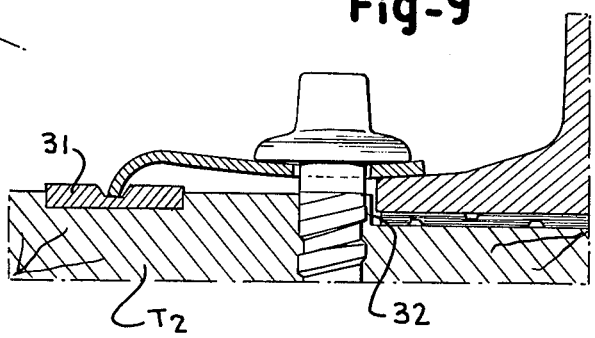
FIG. 9 is a cross-sectional view of another variant of FIG. 2.

The plate S1 is not absolutely necessary. It can, as shown in FIG. 9, be replaced by a simple strip 31, inlayed in the sleeper T2, a notch 32 in the sleeper T2 then acting as lateral abutment for the rail.

The fastener according to the invention can be used for fastening rails on wooden sleepers as well as on any other supports adapted to receive sleeper-screws or like tightening means. Such supports are for example concrete slabs or sleepers into which has been fitted a hollow socket of shape complementary to the threaded body 7 of the sleeper-screw shown in FIG. 3.

What is claimed is:

1. A resilient fastener for fastening a rail on its support, constituted by a flexible blade comprising a longitudinal edge parallel to the axis of the rail and applied against the rail flange, and resting on the rail support, wherein said blade comprises two orifices situated at equal distance from the said longitudinal edge and arranged so that when the said fastener is fitted, the orifices are situated above the rail support and close to the edge of the rail, the said longitudinal edge being curved to assume a convex shape providing a convex face and a concave face, and its convex face facing the rail flange when in fastening position, the flexible blade being of constant thickness, and the said convex shape of said blade presents, when not fitted on the rail, a substantially cylindrical surface of which the directrix is a curve inscribed between the warped shape which the blade would adopt if loaded in its center, and the arc of circle of radius $\rho_0$ passing through said center and the centers of said orifices.

2. A fastener as claimed in claim 1, wherein the directrix is formed by three arcs of circle comprising a central arc of radius smaller than $\rho_0$ and two arcs of radius larger than $\rho_0$ and traversing the centers of said orifices.

3. A fastener as claimed in claim 1, wheren said fastener is provided with a projecting part resting on the rail support.

4. Fastening of a rail on its support, wherein said fastening is achieved by tight screwing on said support using two sleeper-screws which go through the resilient fastener of claim 1, said fastener being provided with two orifices for receiving said sleeper-screws.

* * * * *